United States Patent [19]

Ohl

[11] Patent Number: 4,995,819

[45] Date of Patent: Feb. 26, 1991

[54] SET OF STRIPS OF ELECTRICAL TERMINALS AND A METHOD OF LOADING AN ELECTRICAL CONNECTOR WITH SAID TERMINALS

[75] Inventor: William C. Ohl, Harrisburg, Pa.

[73] Assignee: AMP Incorporated, Harrisburg, Pa.

[21] Appl. No.: 408,444

[22] Filed: Sep. 15, 1989

Related U.S. Application Data

[63] Continuation of Ser. No. 202,167, Jun. 3, 1988, abandoned.

[51] Int. Cl.[5] ..... H01R 9/09

[52] U.S. Cl. ..... 439/79; 439/82; 439/444; 439/609; 439/830

[58] Field of Search ..... 439/79–82, 439/397, 444, 609, 629, 830, 876

[56] References Cited

U.S. PATENT DOCUMENTS

| | | | |
|---|---|---|---|
| 3,879,099 | 4/1975 | Shaffer | 339/99 |
| 4,062,616 | 12/1977 | Shaffer | 339/99 |
| 4,147,399 | 4/1979 | Moser et al. | 339/99 |
| 4,241,970 | 12/1980 | Rider et al. | 339/99 |
| 4,327,958 | 5/1982 | Hughes et al. | 439/97 R |
| 4,460,228 | 7/1984 | Lane et al. | 339/99 |
| 4,464,002 | 8/1984 | Suzuki et al. | 439/397 |
| 4,493,525 | 1/1985 | Hall | 339/143 |
| 4,611,878 | 9/1986 | Hall | 339/186 |
| 4,634,208 | 1/1987 | Hall | 339/143 |
| 4,637,669 | 1/1987 | Tajima | 439/95 |
| 4,695,105 | 9/1987 | Ney et al. | 439/95 |
| 4,775,336 | 10/1988 | Paulo | 439/830 |
| 4,908,335 | 3/1990 | Cosmos et al. | 439/79 |

*Primary Examiner*—Paula A. Bradley

*Attorney, Agent, or Firm*—David L. Smith

[57] ABSTRACT

A set of strips of electrical terminals connected together by carrier strips (122 and 120) each comprises electrical terminals (95) each having a receptacle portion (96), a barbed retention part (98) for retaining the terminal in a terminal receiving cavity (62) in an insulating housing (14), a terminal leg and a cranked arm (102) connecting the retention part (98) to the terminal leg (100). The leg (100) has intermediate its ends a retention member (108), the leg (100) terminating in an insertion lance (112) for insertion in a hole (H) in a substrate (S). The set of terminal strips, comprises pairs of terminal strips, the arms (102) of the terminals of each pair of said strips being cranked in opposite senses. The portion (114) of the leg (100), between the arm (102) and retaining member (108) varies in length from pair of terminal strips to pair of terminal strips. The angle of crank of the arm (102) similarly varies. The invention enables the terminals (95) when they have been severed from the strips, to be selectively inserted into terminal receiving cavities (62) arranged in superposed rows in such a way that the insertion lances (112) are level with each other in two parallel rows, the spacing between the insertion lances (112) of the rows being determined by the angles of crank of the arms (102).

3 Claims, 8 Drawing Sheets

SET OF STRIPS OF ELECTRICAL TERMINALS AND A METHOD OF LOADING AN ELECTRICAL CONNECTOR WITH SAID TERMINALS

This application is a Continuation of U.S. application Ser. No. 202,167 filed June 3, 1988, now abandoned.

FIELD OF THE INVENTION

This invention relates to a set of strips of electrical terminals connected together in spaced relationship by means of carrier strips, and to a method of loading an electrical connector with these terminals.

BACKGROUND OF THE INVENTION

There is disclosed in US-A-4,637,669, an electrical connector comprising a plurality of terminal receiving cavities arranged at different levels, each terminal comprising a mating portion in a respective one of the cavities, and a terminal leg projecting below the connector housing, in which the cavities are formed. The terminal legs extend at right angles to the mating portions of the terminals, being connected to the rear ends thereof by rectilinear arms. Each terminal is thus substantially uniplanar. The end of portions of the terminal legs are intended for insertion in holes in a substrate and these holes must accordingly be spaced according to the spacing of the mating portions of the terminals, that is to say in accordance with the spacing of the cavities.

SUMMARY OF THE INVENTION

The invention is intended to provide a set of strips of electrical terminals, the terminals of each strip being configured so that the arrangement of the holes in the substrate may be determined by the customer for the connector, rather by the arrangement of the terminal receiving cavities of the connector.

According to, the invention therefore, each terminal of each strip comprises a cranked arm connecting the mating portion of the terminal to the terminal leg, the terminal strips comprising a plurality of pairs of terminal strips. The arms of the terminals of each pair of said strips being cranked in opposite senses and the legs of the terminals differing in length from pair of terminal strips to pair of terminal strips.

The terminals are also provided with means for retaining the legs in notches formed in a terminal leg spacer plate projecting from the connector housing and being formed integrally therewith. The housing can therefore be a one piece housing and need not be made up of separate parts according to disclosure of US-A-4,637,669. The angle of crank of the arms can be so selected, that the terminal legs project below said spacer plate in a desired number of rows, with a predetermined spacing between legs, as may be required by the customer.

The invention further concerns a method of loading such an electrical connector with the terminals, in which method, the terminals are selectively inserted into their respective cavities so that insertion lances in which the terminal legs terminate, project below the spacer plate to an equal extent and in parallel rows with a predetermined spacing between the terminals of each row, which is predetermined by the angles of crank of said arms.

DETAILED DESCRIPTION OF THE INVENTION

For a better understanding of the invention, reference will now be made by way of example to the accompanying drawings in which:

FIG. 16 is a diagram illustrating the arrangement of electrical terminal receiving cavities in respective modifications of the connectors and the arrangement of holes in a substrate upon which connectors according to said modification are to be mounted;

Figure 1:
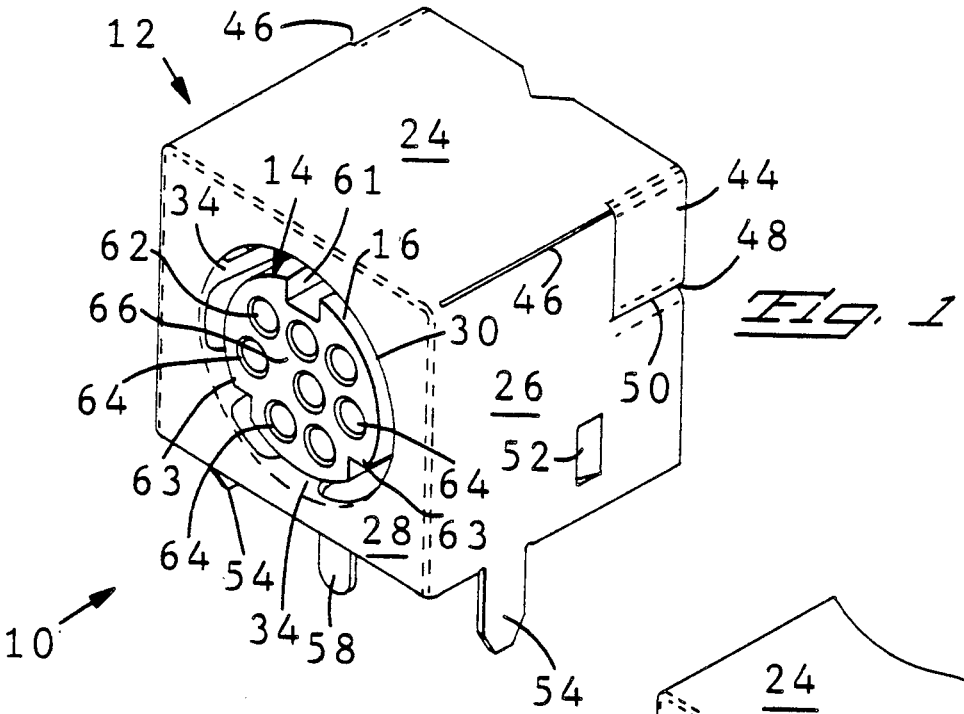
FIG. 1 is a fragmentary isomotric view of a shielded, surface mounted eight position electrical connector.
Figures 1A, 2, 3:
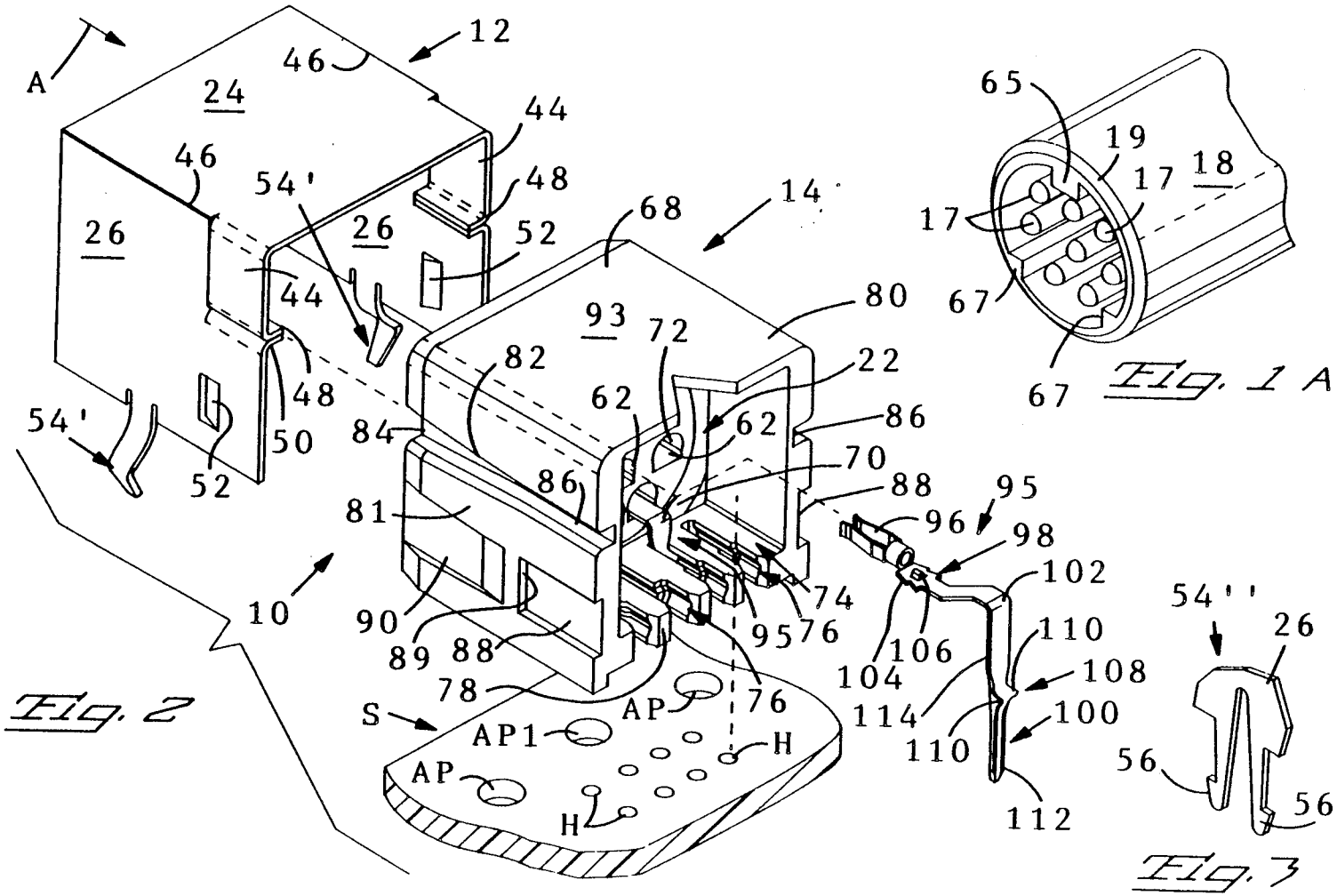
FIG. 1A is a fragmentary isometric view of a shielded electrical socket.
FIG. 2 is an isometric, partly diagramatic exploded view of a modified version of the connector.
FIG. 3 is a fragmentary isometric view illustrating a modification of the mounting feet of the connector of FIG. 2.

As shown in FIGS. 1 and 2, a shielded electrical connector for mounting on a substrate, for example a printed circuit board, comprises a one piece metal shield 12 and a substantially rectangular cross-section, one piece, molded, insulating connector body 14. There projects from the connector body 14, forwardly, a circular cross-section plug portion 16 for mating with a circular cross-section externally shielded electrical socket 18 (FIG. 1A) having a metal shield 19, and into which project electrical pins 17.

Figure 11:
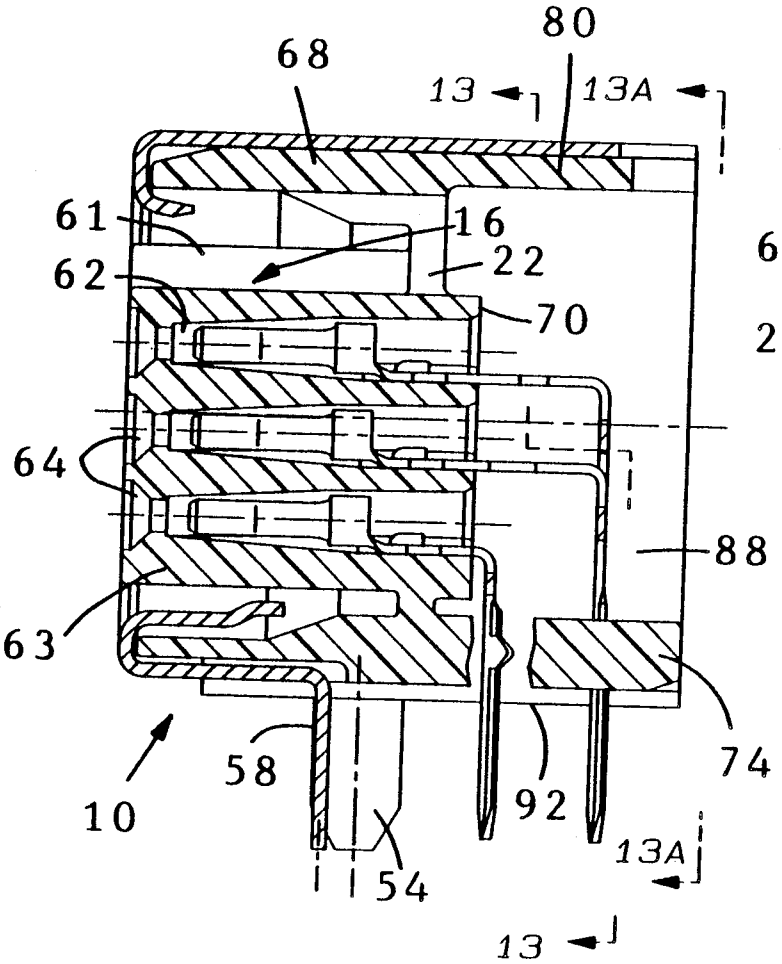
FIG. 11 is an axial actual sectional view of the shielded connector of FIG. 1.

As best seen in FIG. 11, the body 14 has a central portion 22 from which the plug portion 16 projects.

Figure 4:
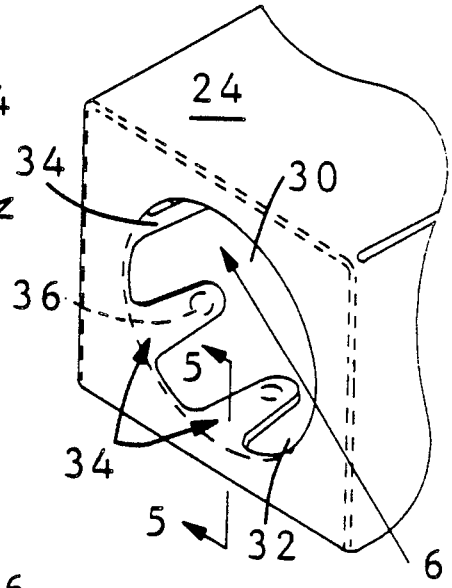
FIG. 4 is a fragmentary isometric view of a part of the metal shield of the connector of FIG. 1.
Figure 6:
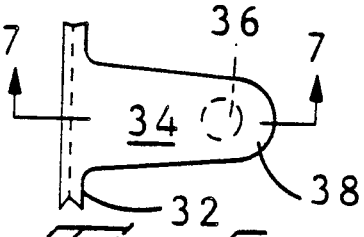
FIG. 6 is a fragmentary view taken in the direction of the arrow 6 in FIG. 4.
Figure 7:
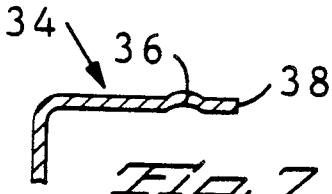
FIG. 7 is a view taken on the lines 7–7 of FIG. 6.

The shield 12 comprises a top wall 24, a pair of side walls 26, each adjacent to the top wall 24 and depending from opposite lateral edges thereof. A front wall 28 adjacent to the top wall 24 and the side walls 26, is formed integrally therewith and has a circular, through opening 30 therein, for receiving the socket 18. The opening 30 has a circular edge 32 from which project a series of resilient cantilever fingers 34 on the shield 12, rearwardly thereof, for engaging the external shielding 19 of the socket 18, the fingers 34 being constantly spaced from one another about the edge 32. Fingers 34 are formed from the portion of surface 28 that otherwise would enclose opening 30. As shown in FIGS. 4, 6 and 7, each finger 34 has formed therein an embossment 36 proximate to, but spaced back from, its free end 38 and projecting in the radially inward direction of the opening 30 in order to limit free deflection of the fingers 34 by the socket portion 18 as it is being mated with the plug portion 16, so that the shield 19 of the latter engages the embossments 36 and does not overstress the fingers 34.

Figure 8:
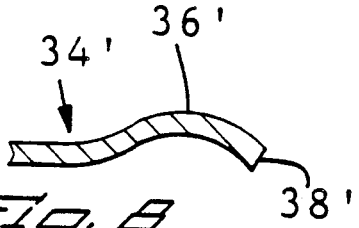
FIGS. 8 and 9 are a longitudinal sectional view and an isometric view, respectively, illustrating a modification of the part shown in FIGS. 6 and 7.
Figure 9:
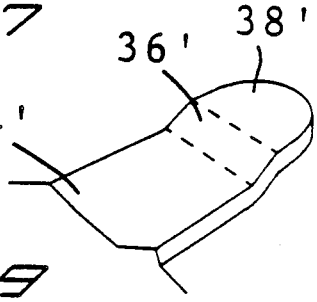

According to the modification shown in FIGS. 8 and 9, in which the finger is referenced 34' and the embossment, 36', the embossment 36' is formed at the end of the finger 34'.

Figure 5:
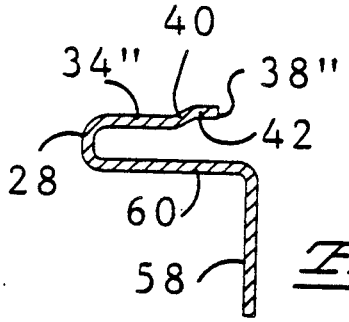
FIG. 5 is a view taken of the lines 5–5 of FIG. 4.

According to the modification shown in FIG. 5, the finger, which is referenced 34" is formed with a joggle 40 spaced back from its free end 38" to provide a raised shoulder 42 for engaging the shield 19.

Figures 13, 13A:
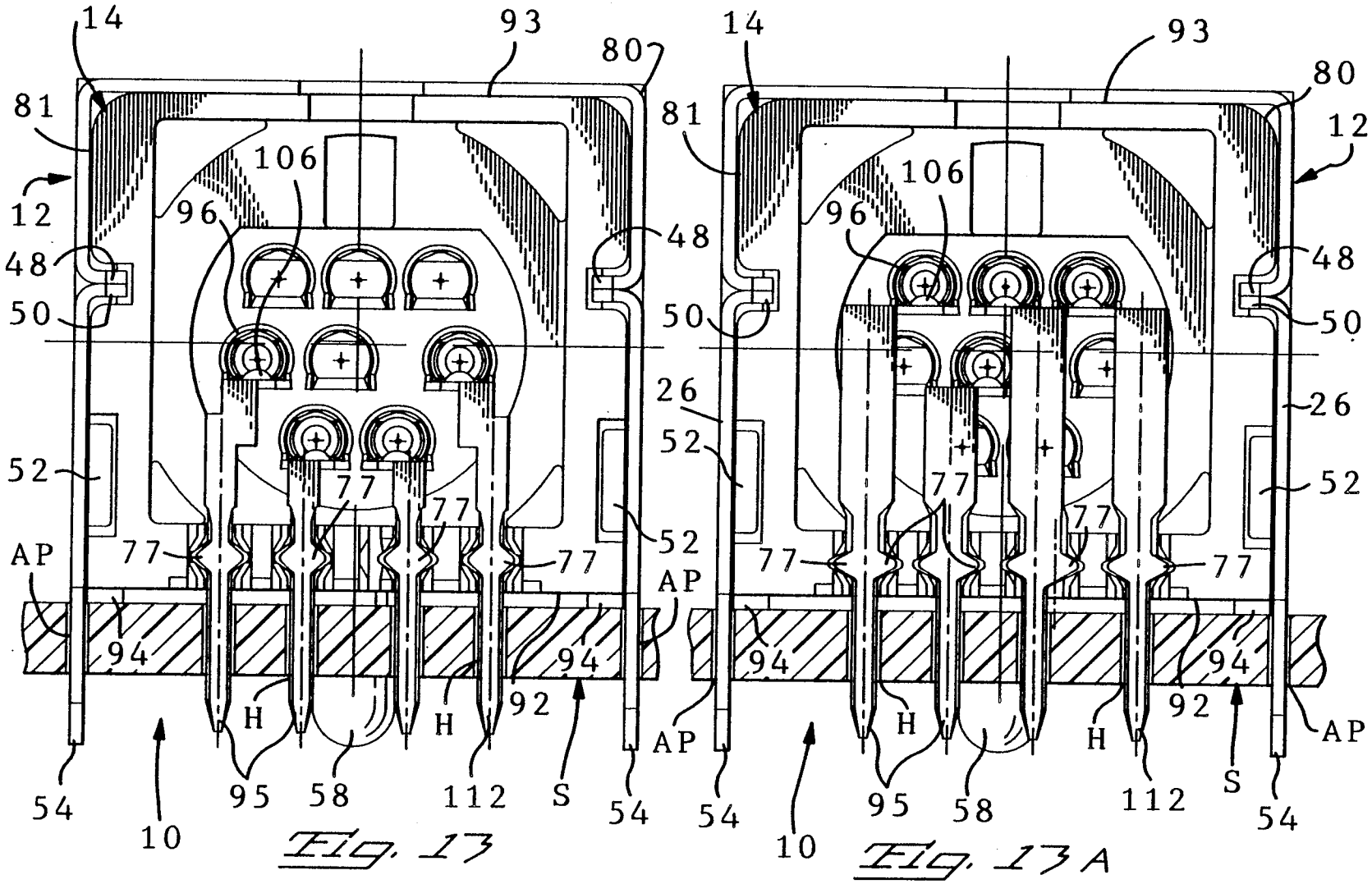
FIG. 13 is a rear view of the connector of FIG. 1 having the terminals in the forward substrate row of holes secured therein.
FIG. 13A is a rear view of the connector of FIG. 2 having the terminals in the rearward substrate row secured therein.
Figure 14:
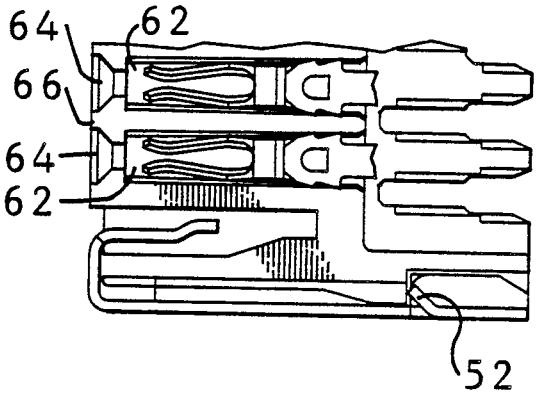
FIG. 14 is a fragmentary horizontal sectional view of the connector of FIG. 1.
Figure 15:
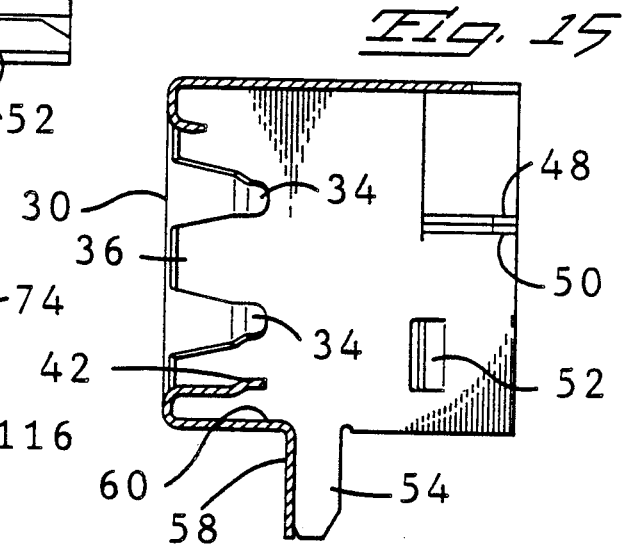
FIG. 15 is an axial sectional view of the shield of the connector of FIG. 1.

There depend from opposite lateral edges 46 of the top wall 24 at its rear end, that is to say at its end remote from the front wall 28, tabs 44, each tab 44 terminating in a flange 48, the flanges 48 projecting towards each other, that is to say inwardly of the shield 12. Just below (as seen in FIGS. 2 and 13, as well as in FIG. 15), each flange 48 the respective side wall 26 is formed with a further inturned flange 50, extending parallel to, and being contiguous with, the flange 48 thereabove. Below the flange 50, each side wall 26 has struck out therefrom, a detent 52 in the form of a resilient tongue projecting obliquely interiorly of the shield 12 proximate to its rear end.

Figure 10:
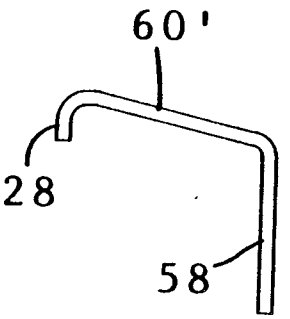
FIG. 10 is a similar view to that of FIG. 5 but illustrating a modification of the parts shown therein.

The shield 12 is further provided with means for securing it to the substrate S, in the form of mounting feet 54 (FIGS. 1, 11, 13, and 15), 54' (FIG. 2), or 54" (FIG. 3) depending from the respective side walls 26. The mounting feet 54 are in the form of a simple tab, the mounting feet 54' being in the form of claws which are bowed in opposite directions, outwardly of the shield 12, the mounting feet 54" being bifurcated and thus comprising two portions, each portion terminating in a barb 56 and said portions being resiliently deflectable towards each other. The front wall 28 is provided with a further mounting foot 58 depending from a rearward extension 60 of the front wall 28 extending parallel to the top wall 24 or, as shown in FIG. 10, an extension 60' of the front wall 28 extending obliquely downwardly therefrom. Said extensions may be said to constitute rudimentary bottom walls of the shield 12.

The plug portion 16 is formed with terminal receiving, parallel cavities 62 extending therethrough, axially thereof and each having a pin receiving flared mouth 64 opening into a mating face 66 body of the plug portion 16. The central portion 22 has projecting forwardly therefrom a hood 68 surrounding the plug portion 16 in spaced relationship thereto, to allow the socket 18 to be mated with the plug portion 16. The portion 22 of the housing 14 has a terminal receiving face 70 opposite to the mating face 66, each cavity 62 extending through the portion 22 and having a terminal receiving mouth 72 opening into the face 70.

The plug portion 16 has axial keyways 61 and 63 for the reception of complementary keys 65 and 67 in the socket 18.

A terminal leg spacer plate 74 extending along the lower edge of the face 70, in a direction away from the plug portion 16 is formed with a plurality of elongate, in the axial direction of the cavities 62, terminal leg receiving spacer notches 76 each extending normally of the face 70 and opening into the rear edge 78 of the spacer plate 74, remote from the face 70, each notch 76 being shaped for the retention two terminal legs therein, to correspond to the two rows of terminal leg receiving apertures in the footprint of the connector.

Notches 76 in spacer plate 74 define sidewalls 75. V-shaped grooves 77 in sidewalls 75 receive lugs 110, which are preferably pointed as shown in FIGS. 13 or 13A, skive side walls 75 upon insertion and prevent withdrawal of legs 100 from notches 76. Lugs 110 not only secure leg 100 in notch 76 but also prevent leg 100 from moving normal to spacer plate 74.

Figure 12:
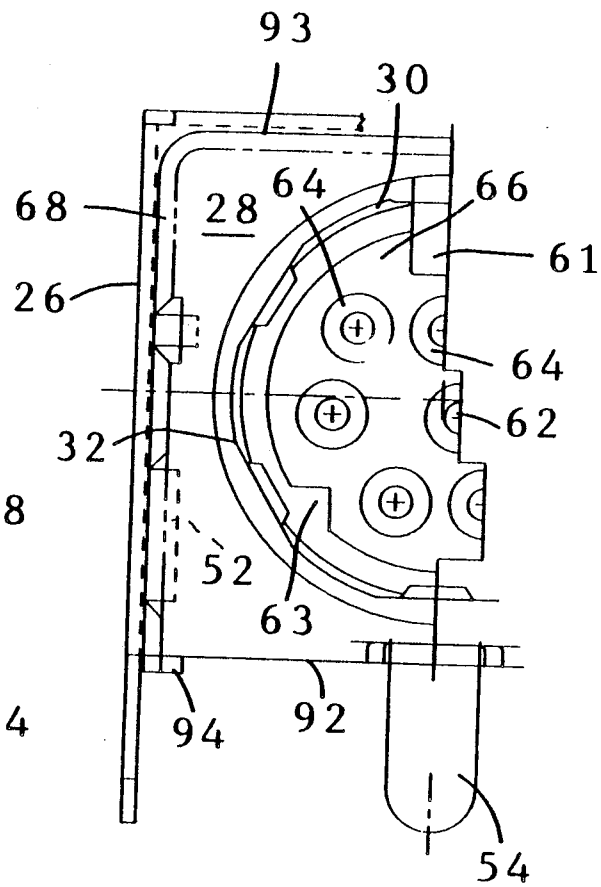
FIG. 12 is a fragmentary front view of the shielded connector of FIG. 1.

A protective skirt 80 projects from the face 70 of the portion 22, rearwardly from the periphery thereof and adjoins each end of the spacer plate 74. The hood 68, the portion 22, and the skirt 80 are formed on each side wall 81 of the body 14 with a common external groove 82 opening into the forward edge of the hood 68 and the rear edge of the skirt 80, each groove 82 having a flared flange receiving mouth 84 opening into the forward edge of the skirt 68 and a deepened portion 86 opening into the rear edge 78 of the skirt 80. Each side of the skirt 80 is formed with a recess 88 opening into the rear edge of the skirt 80 below the groove portion 86, defining shield retaining shoulder 89. The hood 68 is formed on either side thereof with an external relief recess 90 opening into the forward edge of hood 68. The body 14 has a bottom mounting face 92 opposite to its top wall 93, provided with stand offs 94 as shown in FIGS. 11 to 13, the face 92 being parallel to the plate 74.

Electrical terminals 95 each for reception in a respective cavity 62 each comprise a forward, mating part in the form of a receptacle 96, an intermediate insertion and retention part 98 connected to the rear end of receptacle 96 and a terminal leg 100 connected to the rear end of the part 98 by way of an arm 102, the leg 100 extending at right angles to the remainder of the terminal 95. The receptacle 96 is formed in accordance with U.S. patent application Ser. No. 806,149, filed on Dec. 6, 1985, now abandoned, and the insertion and retention part 98 which comprises a laterally barbed retention plate 104 and an insertion hump 106 is formed in accordance with U.S. patent application Ser. No. 094,944 filed on Sept. 9, 1987, now U.S. Pat. No. 4,775,336, both of which patent applications are incorporated herein by reference. The leg 100 is provided with retaining means in the form of a substantially U-shaped retaining member 108 presenting retention lugs 110, shown in outline in FIG. 2. Each leg 100 has an insertion lance 112 below the member 108 and a leg portion 114 between the member 108 and the part 98. A rear view of the terminals 95 in body 14 is shown in FIGS. 13 and 13A.

In order to assemble the shield 12 to the connector body 14, the terminals 95 having been inserted into the cavities 62 with the forward ends of the receptacles 96 thereof proximate to the mouths 62 and their legs 100 retained in the notches 76 by means of the retaining members 108, the shield 12 is slid onto the connector body 14 in the direction of the arrow A in FIG. 2. During this operation, the flanges 48 and 50 enter the grooves 82, guided by their flared mouths 84, and finally snap into the deepened portions 86 of the grooves 84, the detents 52 likewise snap into the recesses 88. The shield is thereby firmly anchored to the body 14.

The lances 112 which protrude below the mounting face 92 are then inserted into respective holes H in the substrate S, the mounting feet 54, 54' or 54", as the case may be, entering respective apertures AP in the substrate S, and the mounting foot 58 entering an aperture AP1 in the substrate S. The mounting feet 54 and 58 simply wedge in their respective apertures. The mounting feet 54', however, are resiliently depressed inwardly of the shield 12 by the edges of the apertures AP, being accommodated by the recesses 90, and finally resile, to engage against the lower surface of the substrate S. The two portions of each mounting foot 54" are compressed towards each other by the edge of the respective aperture AP and finally resile, so that the barbs 56 engage against the lower surface of the substrate S.

Figure 15A:
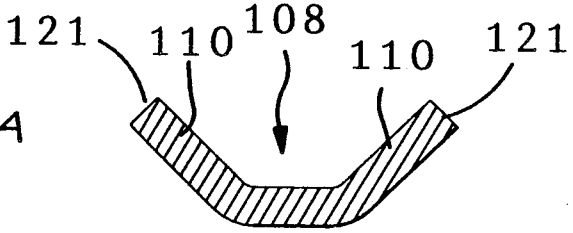
FIG. 15A is a cross-section through a retaining member of an electrical terminal shown in FIG. 2.
Figure 15:
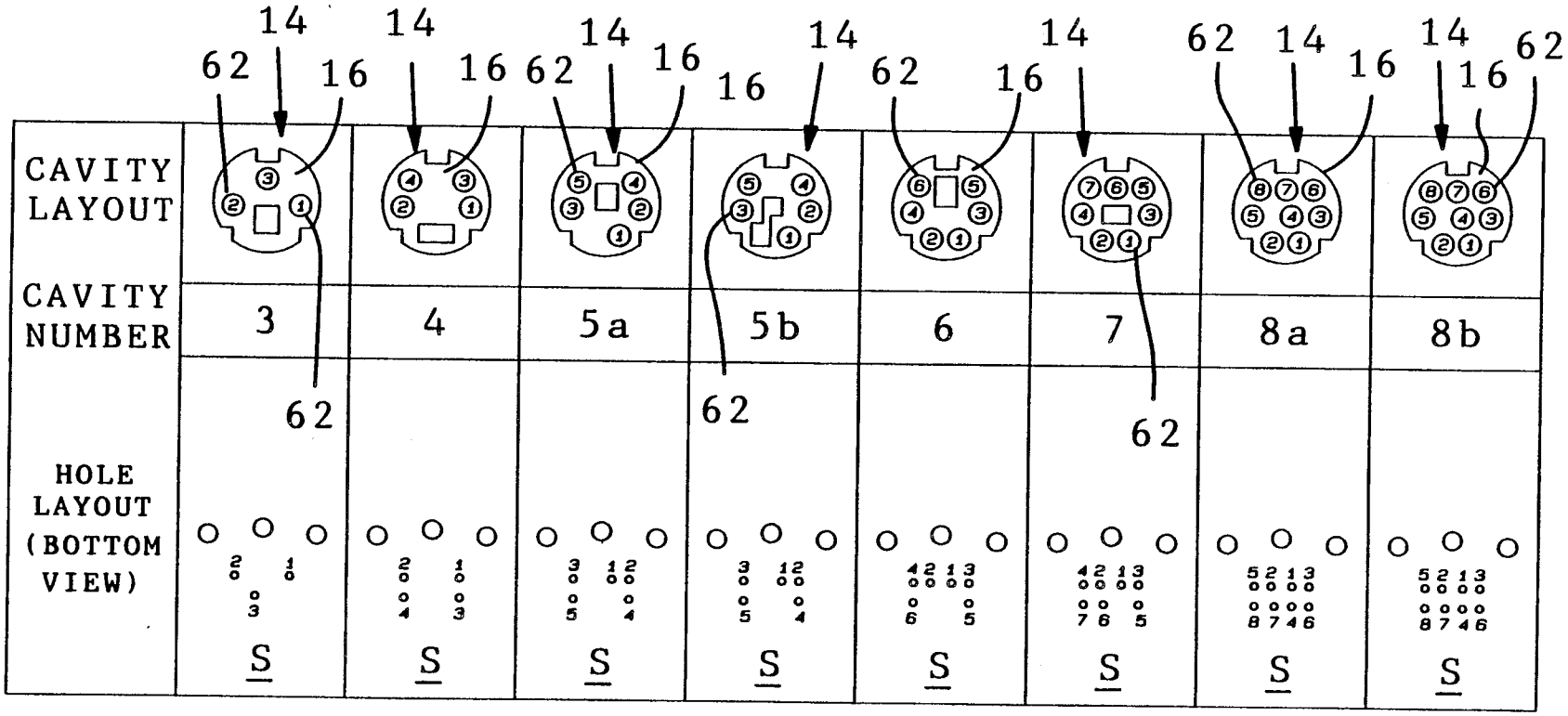

Preferably, as shown in FIG. 15A, the lugs 110 of each retaining member 108 have sharp edged skiving wings 121 projecting therefrom for biting into the walls of the respective notch 76. Lugs 110 are preferably pointed as shown in FIGS. 13 or 13A with lugs 110 complementary to and received in grooves 77 in sidewalls 75.

Figure 17:
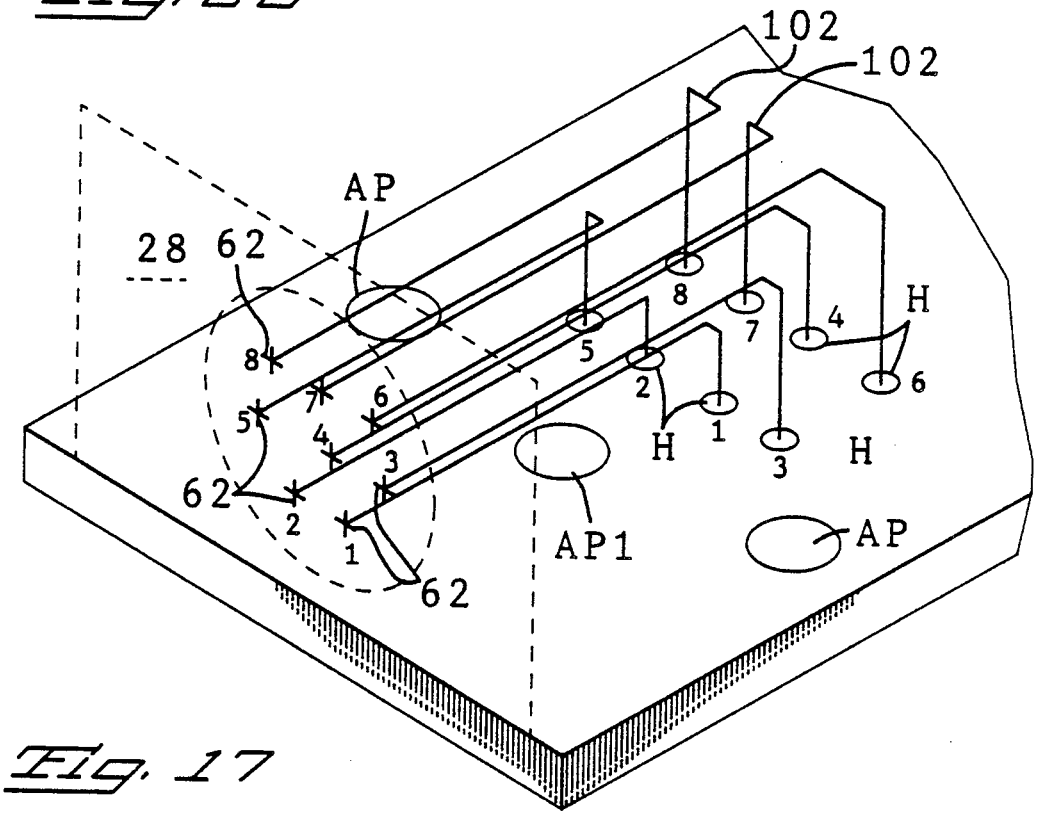
FIG. 17 is a diagram illustrating the general configuration of electrical terminals of an eight position connector to enable legs of the terminals to be received in cavities provided, in a substrate in two rows.

As illustrated in FIG. 16, the body 14 may have different numbers of terminal receiving cavities 62 and differently arranged keyways. The cavities 62 may be arranged at two or three levels displaced from one another in a direction perpendicular to the mounting face 92, although the holes H in the substrate S are, in each case, arranged in two rows only. This means that the lengths of the legs 100 and the configuration of the arms 102 must be adapted both to the layout of the cavities 62 and to that of the holes H. The insertion lances 112 of all the terminals 95 must, of course, all be of the same length. In FIG. 16 the cavities 62 are numbered 1 to 3, 1 to 4 and so on up to 1 to 8, and the holes H are correspondingly numbered. Where there are, for example, eight cavities disposed in three rows (see **8*a* and 8*b* in FIG. 16), the configuration of the arm 102 and the leg portion 114 must be different in respect of each terminal 95. That is to say since the holes 2 are arranged in only two rows, and since the cavities are differently spaced from the spacer plate 74, the arm 102 and leg 100 of each terminal must be dimensioned to compensate for such mis-matching. As shown diagrammatically in FIG. 17, in which the cavities are numbered 1 to 8 and holes are also numbered 1 to 8, the terminals 95 are arranged in four pairs, namely those for the cavities 1 and 2, the cavities 3 and 5, the cavities 4 and 7, and the cavities 6 and 8 respectively, the terminals 95 of each pair being configured so that their arms 102 are cranked in mirror image relationship with one another, that is to say the arms 102 of each pair of terminals 95 offset the legs 100 of the pair in opposite sense with respect to the receptacles 96** thereof.

Figure 18:
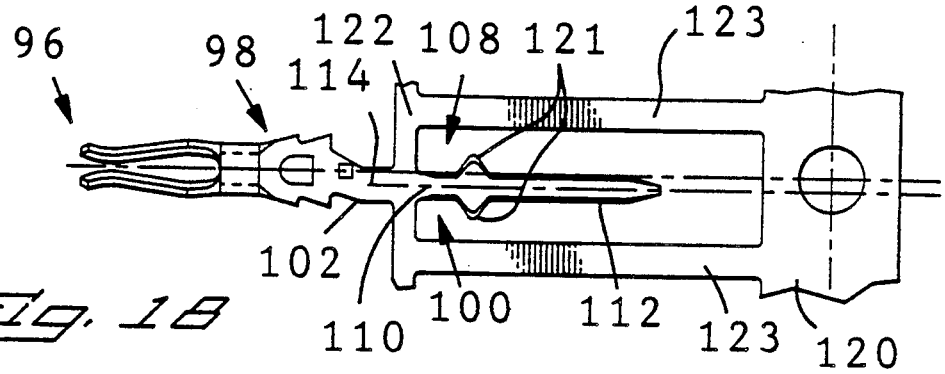
FIGS. 18 to 25 are views of respective electrical terminals.
Figure 19:
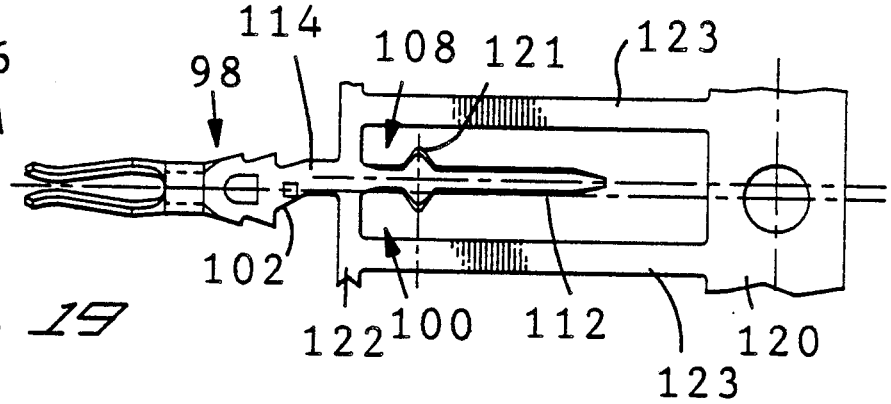
Figure 20:
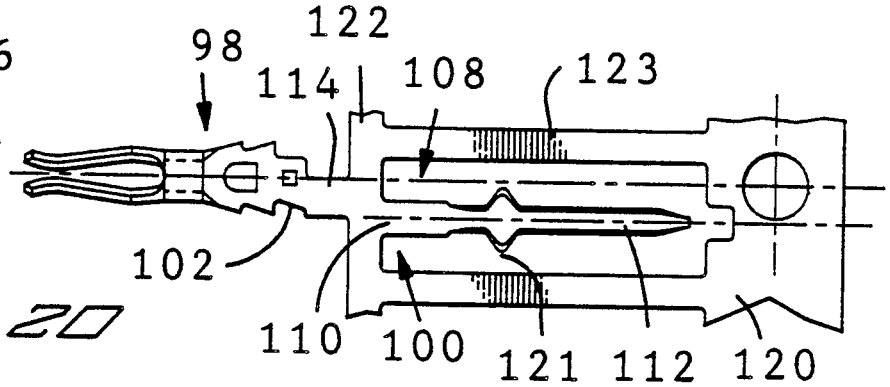
Figure 21:
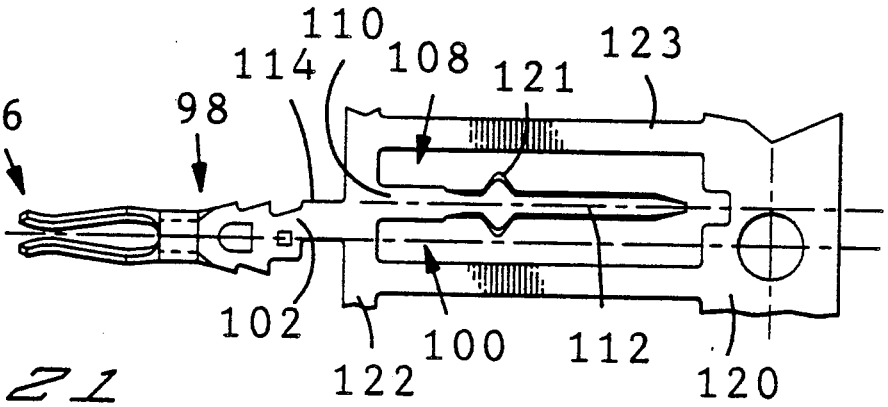
Figure 22:
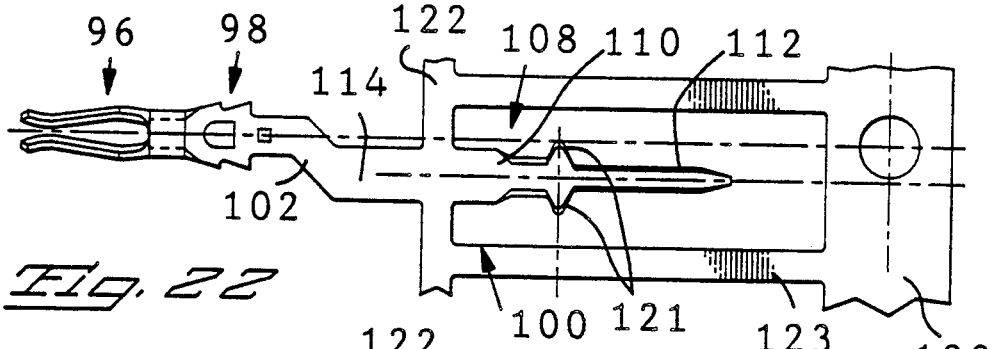
Figure 23:
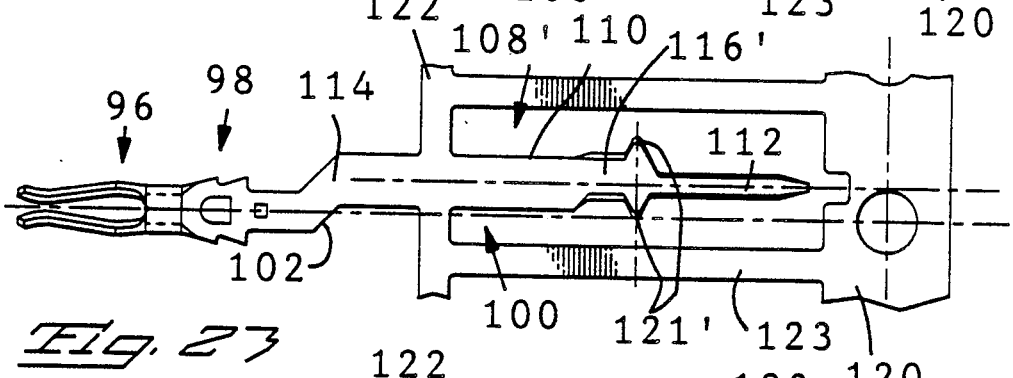
Figure 24:
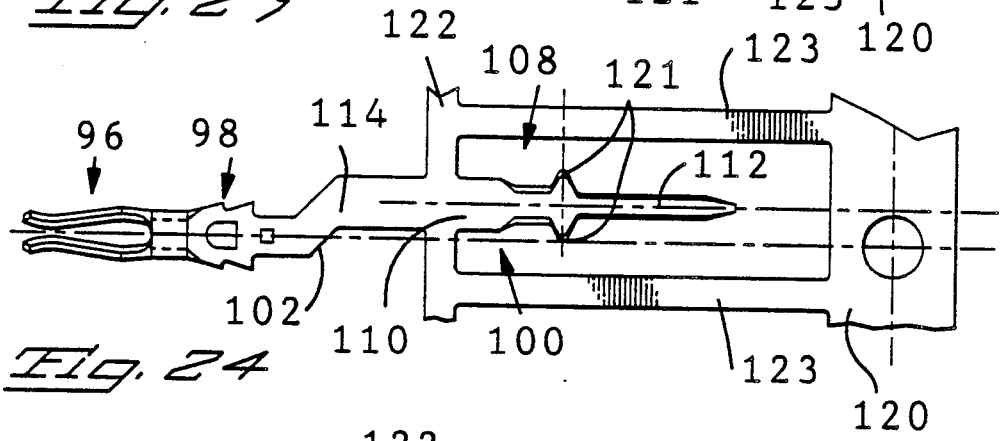
Figure 25:
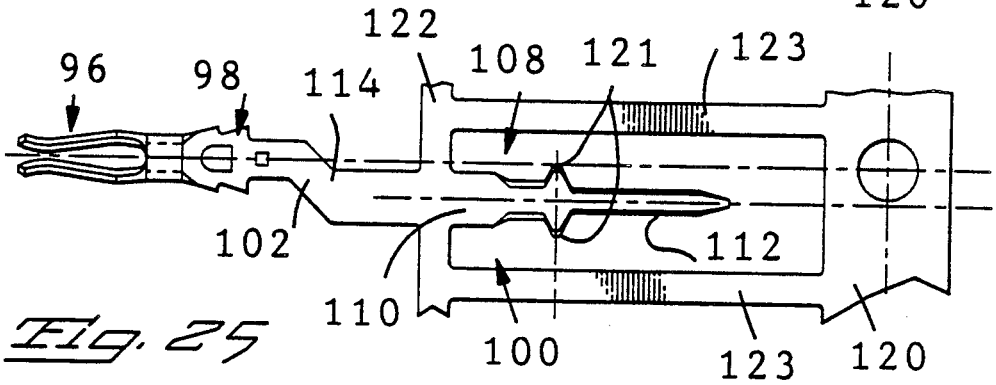

FIGS. 18 to 25, in which the parts are referenced in the same way as the terminal parts in FIG. 2 show, in fragmentary plan view, strips of the respective pairs of terminals 95. FIGS. 18 and 19 show the terminals for the cavities 1 and 2, in the bottom row, in which the arms 102 are oppositely directed to the same extent and the leg portions 114 are the shortest As shown in FIGS. 20 and 21, the leg portions 114 are longer than those of FIGS. 18 and 19 because both of the terminals of these Figures are in the second row up from the plate 74, i.e, the middle row. The arms 102 in FIGS. 18 and 19 and in FIGS. 20 and 21 offset the legs 100 from receptacles 96 to substantially the same extent because, as will be apparent from FIG. 16, the cavities 1 and 2 are offset from the holes 1 and 2 to substantially the same extent as the cavities 3 and 5 are offset from the holes 3 and 5. In the terminal for the cavity 4, shown in FIG. 22, which is a middle row terminal, the leg portion 114 is shorter than that of the terminal shown in FIG. 23 which is for a top row terminal. Each arm 102 in FIGS. 22 and 23 offsets the receptacle 96 from the leg 100 of respective terminals received in cavities 4 and 7 to accommodate the respective offset in holes 4 and 7 in substrate S, since the cavities 4 and 7 are offset from the holes 4 and 7. The offsets afforded by the arms 102 are, however, greater than in the case of the terminals of FIGS. 20 to 23. The terminals shown in FIGS. 24 and 25 are for the cavities 6 and 8, respectively, which are the outside cavities of the top row and the arm portions 114 in both of these figures are, therefore, of equal length. However, although the offset afforded by the arms 102 is equal to that afforded by the arms 102 in FIGS. 22 and 23, the arms 102 are longer in FIGS. 24 and 25.

Each of the terminals shown in FIGS. 18 to 25 forms part of a discrete strip of terminals joined in side by side relationship by carrier strips 120 and 122, which are primary and secondary carrier strips, respectively, and are connected by transverse strips 123. The length of each leg portion 114 is determined by the positioning of the secondary carrier strip 122 therealong.

Figure 26:
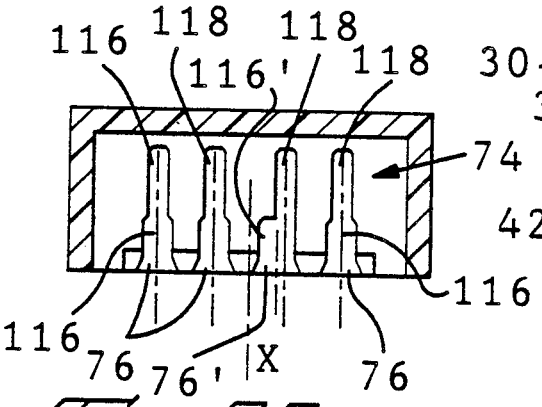
FIG. 26 is a plan view shown partly in section illustrating a modification of a detail of the connector of FIG. 1 or 2.

It will be apparent that each of the notches 76 must receive the retaining members 108 of two of the terminals 95 since the notches 76 are four in number whereas the terminals 95 are eight in number. To this end, as shown in FIG. 26 each notch 76 has a wider part 116 for receiving the retaining member 108 of one terminal 95, communicating with a narrower part 118 for receiving the retaining member 108 of another terminal 95. Where there are eight cavities 62, each of eight different terminal strips are produced as shown in FIGS. 18 to 25 respectively, each terminal is severed from its strip and, during manufacture of the connector 10, is selectively inserted into its respective cavity 62 in its proper orientation by means of a stitching machine, after the body 14 has been molded. Where there are fewer than eight cavities 62, appropriate ones of the terminals manufactured for a body 14 with eight cavities, are inserted into these fewer cavities.

A rear view of terminals 95 in body 14 is shown in FIGS. 13 and 13A. Terminals 95 that are received in the row of holes H in substrate S closer to mating face 66 are shown in FIG. 13; FIG. 13A shows terminals 95 that are received in the row of holes H more distant from mating face 66.

As shown in FIGS. 18 to 25, the skiving wings 121 of each retaining member 108 are positioned at its end nearest to the insertion lance 112.

As shown in FIG. 26, the groove 76' for the terminal shown in FIG. 23 has its wider part 116' offset from the longitudinal axis X of the groove 76' for alignment of the terminal with its hole H. As will be apparent from FIG. 23, the retaining member 108' of the terminal is unsymmetrical to allow for this.

I claim:

1. A set of eight strips of electrical terminals, the terminals of each strip being identical, connected together in spaced relationship by means of carrier strips, each strip of terminals being stamped and formed from a length of sheet metal stock and each terminal comprising an elongate mating part, having a forward and a rear end, a retention part for retaining the terminal in a cavity in an insulating housing and having one end connected to the rear end of the mating part, a terminal leg extending parallel to the mating part and having, intermediate its ends, means for retaining said legs in a recess provided in the housing below said cavity and an arm cranked in the plane of the strip, connecting one end of said leg to said retention part and serving to laterally offset said leg from said mating part, wherein said terminal strips comprise four pairs of terminal strips, the arms of the terminals of each pair of terminal strips laterally offsetting the mating parts of the terminals of said pair from the legs thereof, in opposite directions, the legs of the terminals of a first of the pairs of terminal strips being of a first length, the legs of the terminals of second of the pairs of terminal strips being of a second length which is greater than the first length, the legs of one of the terminals of a third of said pairs being of said second length and the other leg of said third pair being of a fourth length, the legs of the terminals of the fourth of said pairs being of said fourth length which is greater than said third length.

2. A set as claimed in claim 1, wherein the retaining portion of each terminal is of substantially 'U' cross-sectional shape and thus comprising a pair of flanges upstanding for the leg of the terminal, the flanges of said one terminal, being of unequal height and those of the remaining terminals being of equal height.

3. A set as claimed in claim 1, wherein the cranked arms of the terminals of the first pair of terminal strips offset the respective legs of these terminals from the mating portions thereof to a first extent, the arms of the terminals of the second pair of terminal strips offsetting the respective legs of the terminals from the mating parts thereof to a second extent which is substantially equal to said first extent, the arms of the terminals of the third pair of strips offsetting the respective legs from the mating portions thereof to a third extent which is greater than said first or second extent, and the arms of the terminals of the fourth pair of strips offsetting the respective legs of the terminals from the mating portions thereof, to a fourth extent which is greater than said third extent.

* * * * *